US008222834B2

(12) United States Patent
Nakada et al.

(10) Patent No.: US 8,222,834 B2
(45) Date of Patent: Jul. 17, 2012

(54) HID LAMP BALLAST WITH CONTROLLED DC STEP DOWN CIRCUIT

(75) Inventors: Katsuyoshi Nakada, Yawata (JP); Tomoyuki Nakano, Sakai (JP); Junichi Hasegawa, Kashiwara (JP); Koji Watanabe, Yawata (JP)

(73) Assignee: Panasonic Corporation, Osaka (JP)

( * ) Notice: Subject to any disclaimer, the term of this patent is extended or adjusted under 35 U.S.C. 154(b) by 345 days.

(21) Appl. No.: 12/582,173

(22) Filed: Oct. 20, 2009

(65) Prior Publication Data

US 2010/0102757 A1 Apr. 29, 2010

(30) Foreign Application Priority Data

Oct. 21, 2008 (JP) ..... 2008-271378

(51) Int. Cl.

| | |
|---|---|
| ***H05B 37/02*** | (2006.01) |
| ***H05B 39/04*** | (2006.01) |
| ***H05B 41/36*** | (2006.01) |
| ***G05F 1/00*** | (2006.01) |
| *H05B 37/00* | (2006.01) |
| *H05B 39/00* | (2006.01) |
| *H05B 41/00* | (2006.01) |
| *H05B 39/02* | (2006.01) |
| *H05B 41/16* | (2006.01) |
| *H05B 41/24* | (2006.01) |

(52) U.S. Cl. ..... 315/307; 315/209 R; 315/246; 315/291; 315/326

(58) Field of Classification Search ..... None
See application file for complete search history.

(56) References Cited

U.S. PATENT DOCUMENTS

| | | | | |
|---|---|---|---|---|
| 7,129,647 | B2 * | 10/2006 | DuLaney et al. | 315/209 R |
| 7,994,733 | B2 * | 8/2011 | Yufuku et al. | 315/291 |
| 2002/0125834 | A1 * | 9/2002 | Shoji et al. | 315/224 |
| 2006/0049777 | A1 * | 3/2006 | Kumagai et al. | 315/224 |

FOREIGN PATENT DOCUMENTS

| | | |
|---|---|---|
| WO | WO03039211 | 5/2003 |

* cited by examiner

*Primary Examiner* — Douglas W Owens
*Assistant Examiner* — Dedei K Hammond
(74) *Attorney, Agent, or Firm* — Waddey & Patterson, P.C.; Mark J. Patterson; Gary L. Montle

(57) ABSTRACT

An electronic ballast is provided for powering a high intensity discharge lamp. A voltage step-down circuit is arranged to reduce an input DC voltage. An inverter circuit includes at least one high frequency switching element is and arranged to convert the reduced voltage to a high frequency AC voltage. A resonant circuit receives the high frequency voltage and is further coupled to the discharge lamp. A voltage step-down control circuit controls the DC voltage output from the voltage step-down circuit. A driving circuit supplies a driving signal to the switching element of the inverter, and further adjusts a driving frequency of the driving signal, thereby controlling the high-frequency voltage. The high frequency voltage in a first operating mode is controlled to a low level wherein the lamp is prevented from starting. The high frequency voltage in a second operating mode is controlled to a high level wherein the discharge lamp can be started.

20 Claims, 10 Drawing Sheets

HID LAMP BALLAST WITH CONTROLLED DC STEP DOWN CIRCUIT

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: Japan Patent Application No. JP2008-271378, filed Oct. 21, 2008.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to an electronic ballast for powering a high-intensity gas discharge lamp such as a high-pressure mercury lamp or a metal halide lamp. More particularly, the present invention relates to circuitry within an electronic ballast for powering a lamp that prevents operation below a resonance frequency.

Electronic ballasts for powering high-intensity discharge lamps such as high-pressure mercury halide lamps or metal halide lamps are conventionally known in the art. Referring to FIG. 5*a*, a typical example of such a ballast is shown including a voltage step-down circuit 1 that steps down a DC voltage from a direct current power supply (DC) and an inverter circuit 2 including four high-frequency switching elements Q2-Q5 coupled to receive the DC voltage from the step-down circuit and produce a high-frequency AC voltage. An LC resonant circuit 20 is coupled to receive the inverter output and further coupled to the terminals of a discharge lamp (La). An inverter driving circuit 3 outputs a driving signal for controlling the switching elements Q2-Q5. A voltage step-down control circuit 4 regulates the voltage output from the voltage step-down circuit 1.

The voltage step-down circuit 1 of the present example further includes an inductor L, a capacitor C1, a diode D1 and a switching element Q1 such as a synchronous rectifier Q1. The voltage step-down circuit 1 steps down the DC voltage from the DC power supply by switching on and off the switching element Q1 and provides the stepped-down DC voltage across either end of capacitor C1. A current sensor such as a resistor Ra is connected to one end of the DC power supply for detecting a load current flowing through the discharge lamp La. The voltage step-down control circuit 4, which may be a microprocessor, applies a driving signal to the switching element Q1 for controlling the switching rate of the switching element Q1. The voltage step-down control circuit 4 changes a frequency of the driving signal according to the load current detected across the resistor Ra, thereby controlling the voltage output from the voltage step-down circuit 1 to a predetermined voltage level.

The inverter circuit 2 is configured such that a series connected circuit including the switching elements Q2, Q3 is coupled in parallel to a series connected circuit including the switching elements Q4, Q5. The resonant circuit 20 and the discharge lamp La are coupled to a node between the switching elements Q2, Q3 and to another node between the switching elements Q4, Q5. The resonant circuit 20 in this example is an LC circuit including an inductor L2 and a capacitor C2.

A voltage detection circuit 5 that detects the high frequency voltage supplied to the discharge lamp La is coupled to a node between the inductor L2 and the capacitor C2. The voltage detection circuit 5 is configured to include capacitors C3, C4 and diodes D2, D3 that rectify the high frequency voltage, resistors R1-R4 that divide the rectified voltage, and a capacitor C5 that smoothes the rectified voltage. Further, the voltage detection circuit 5 is configured to apply a voltage across either end of the capacitor C5 and to the driving circuit 3.

The driving circuit 3, which may include a microprocessor, supplies a driving signal to each of the switching elements Q2-Q5 so as to alternately switch on and off a first pair of switching elements Q2, Q3 and a second pair of switching elements Q4, Q5, thereby switching the switching elements Q2-Q5 at a high frequency. The driving circuit 3 utilizes frequency sweep control to modulate the driving signal frequency within a predetermined range and to secure proper starting operation even where the inductance or capacitance of components L2, C2 of the resonant circuit 20 vary, or even if the discharge lamp La is at the end of its life and the voltage necessary to start the lamp increases.

Operation of the conventional discharge lamp ballast will be described with reference to FIG. 5*b*. The entire operation here takes place in a startup mode 22 as will be later distinguished from additional modes in operation of the present invention. First, to obtain the high frequency voltage Vhf necessary to start the discharge lamp La, the driving circuit 3 sweep controls the driving frequency Fdrv to be applied to the switching elements Q2-Q5 to approach the resonant frequency of the resonant circuit 20. In this example, the driving circuit 3 sweep controls the driving frequency Fdrv within a range from a maximum frequency Fmax of 120 kHz to a minimum frequency Fmin of 95 kHz. If the voltage detection circuit 5 detects the high frequency voltage applied to the discharge lamp La as having reached a predetermined voltage threshold such as that necessary to start the lamp, then the driving circuit 3 stops sweep controlling the driving frequency and fixes the driving frequency for a predetermined period of time. In this example, the driving circuit 3 fixes the driving frequency at 105 kHz. The voltage output from the step-down circuit Vout_sd remains constant throughout this operation as shown.

During this predetermined period of time, a high frequency voltage of several tens of kilohertz (kHz) to several hundreds of kHz is supplied to the discharge lamp La, and the discharge lamp La is ignited and lit. If the discharge lamp La is not ignited during this predetermined period of time, the driving circuit 3 changes the driving frequency to an initial frequency from the time of activating the ballast and sweep controls the driving frequency again. After the discharge lamp La is ignited, the driving circuit 3 controls the driving frequency to supply a low frequency voltage of several tens of hertz (Hz) to several hundreds of Hz to the discharge lamp La, and maintains steady-state operation of the lamp.

In accordance with this example, if the driving frequency of the driving circuit 3 is close to the maximum frequency in the predetermined range, the high frequency voltage supplied to the discharge lamp La decreases to be almost identical to a voltage detected immediately after lighting of the discharge lamp La. While it is difficult to promptly determine whether or not the discharge lamp is lit, it will nevertheless be determined within a finite period of time whether the discharge lamp is lit or not. Therefore, the discharge lamp La may be lit in a state in which the high-frequency voltage is low, and if so the driving circuit 3 repeatedly sweep controls the driving frequency from a maximum frequency to a minimum frequency.

In the above-stated case, the high frequency voltage changes according to a resonance characteristic, not at a point where the lamp is unlit, but at a point where the lamp is lit. Due to this, even if the driving circuit 3 sweeps the driving frequency to make the frequency lower, the high frequency voltage is of a reduced magnitude and therefore does not reach the predetermined voltage. As a result, conditions for stopping the driving circuit 3 from sweeping are not met and the driving circuit 3 continues sweeping the driving frequency to below the resonant frequency. No problems occur if the discharge lamp La remains lit. However, when the discharge lamp La is turned off, the resonant circuit 20 operates at a frequency lower than the resonant frequency according to the resonance characteristic present at the time the discharge lamp La was extinguished. The below resonance operation may place excessive and potentially destructive stress on the various switching elements of the ballast circuitry.

BRIEF SUMMARY OF THE INVENTION

The present invention has been conceived in view of the prior art as stated above. It is an object of the present invention to provide an electronic ballast capable of preventing below-resonance switching operation.

An embodiment of a lamp ballast of the present invention includes a voltage step-down circuit reducing a DC voltage from a DC power supply, and outputting the reduced DC voltage. An inverter circuit includes at least one high frequency switching element to periodically invert a polarity of the DC voltage from the voltage step-down circuit and output a high frequency voltage. A resonant circuit ignites a discharge lamp by a resonance effect, with the high frequency voltage from the inverter circuit supplied to the resonant circuit.

A voltage step-down control circuit controls the DC voltage output from the voltage step-down circuit. A driving circuit supplies a driving signal for switching the switching elements of the inverter circuit. The driving circuit also changes a driving frequency of the driving signal and thereby controls the high frequency voltage. The driving circuit further includes a frequency setting mode for setting the driving frequency to a frequency near to and above a resonance frequency, and a starting mode for changing the driving frequency to the frequency set in the frequency setting mode and applying the high frequency voltage to the discharge lamp at a level sufficient for ignition of the lamp. The voltage step-down control circuit controls the voltage step-down circuit to reduce the DC voltage output and prevent ignition of the discharge lamp in the frequency setting mode.

The lamp ballast includes a voltage detection circuit detecting the high-frequency voltage. The driving circuit adjusts the driving frequency until the high-frequency voltage detected by the voltage detection circuit in the frequency setting mode reaches a predetermined voltage. The driving circuit then controls the high-frequency voltage so as to fix the driving frequency upon reaching the predetermined voltage.

In the lamp ballast of the present invention, the driving circuit may further control the driving frequency from a preset initial frequency to the frequency set in the frequency setting mode, fix the frequency for a predetermined period of time in the starting mode, and then repeat the control at least once.

The driving circuit may further control the driving frequency from a preset initial frequency to the frequency set in the frequency setting mode, again adjust the driving frequency to the preset initial frequency in the starting mode, and repeat the control at least once.

A lighting fixture further includes the lamp ballast according to various aspects of the present invention herein described, and a fixture main body accommodates therein the discharge lamp lighting device.

A projector further includes the lamp ballast according to various aspects of the present invention herein described.

DETAILED DESCRIPTION OF THE INVENTION

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may. The term "coupled" means at least either a direct electrical connection between the connected items or an indirect connection through one or more passive or active intermediary devices. The term "circuit" means at least either a single component or a multiplicity of components, either active and/or passive, that are coupled together to provide a desired function. The term "signal" means at least one current, voltage, charge, temperature, data or other signal. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa.

Referring generally to FIGS. 1-4, embodiments of an electronic ballast may herein be described for powering a high intensity gas discharge lamp such as a high pressure mercury lamp or a metal halide lamp. The ballast is capable of preventing a resonant inverter circuit coupled to the lamp from operating below resonance. In this manner various ballast circuit components are protected from switching stresses and associated losses that may otherwise occur in prior art systems. Systems incorporating various embodiments of the lamp ballast and methods of its use are further described herein.

Figure 5A:
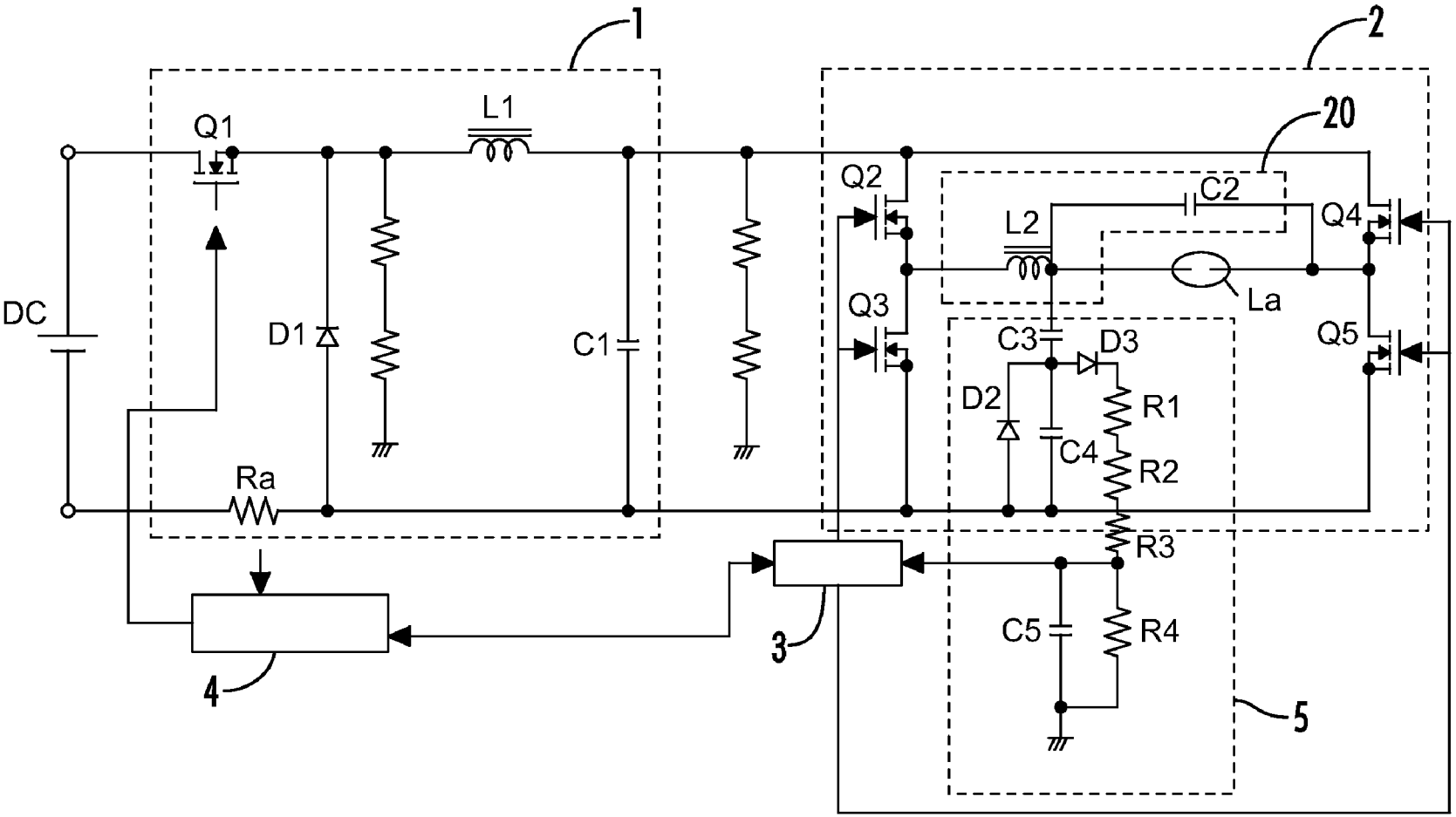
FIG. 5*a* is a circuit diagram showing a prior art lamp ballast.
Figure 5B:
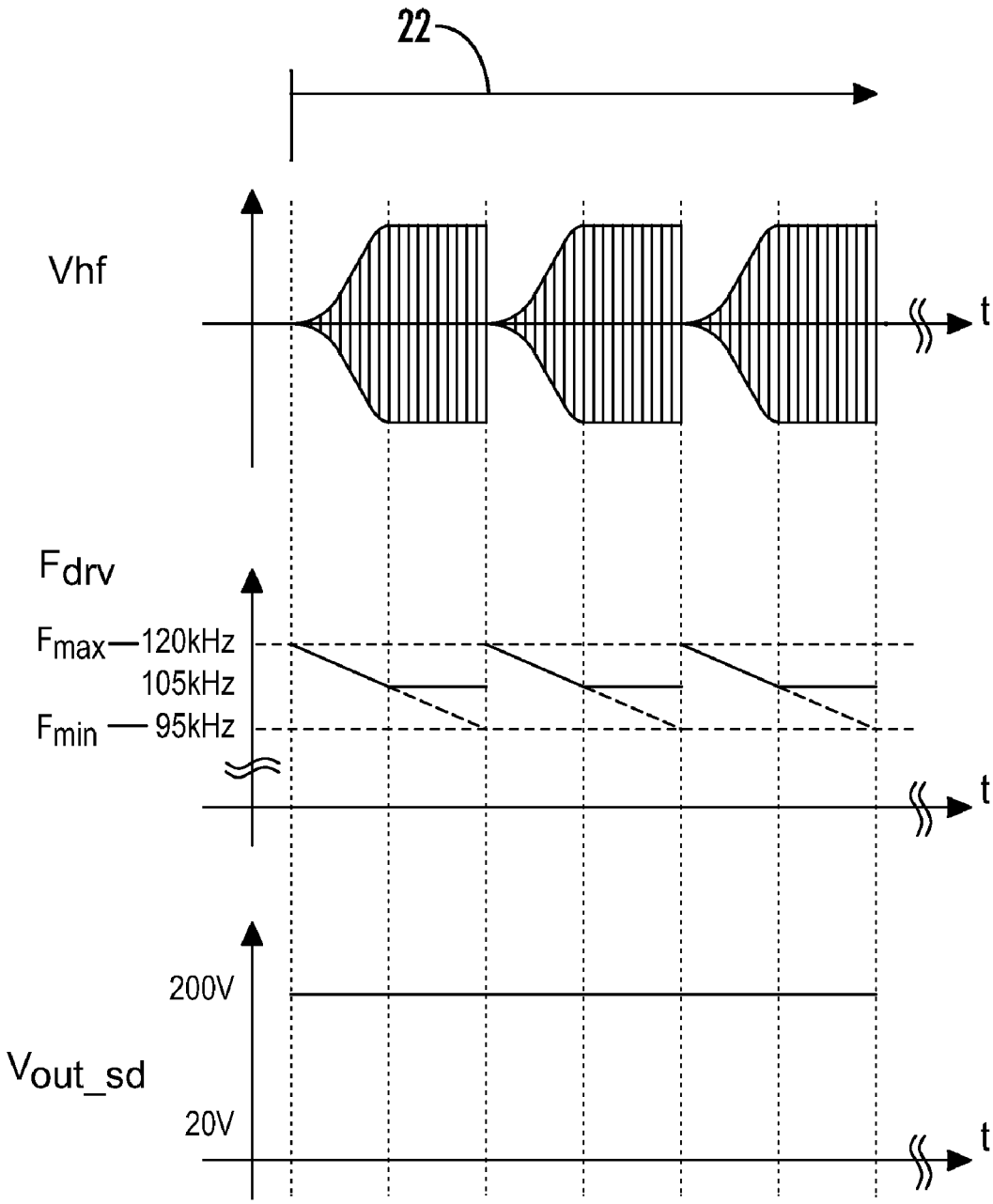
FIG. 5*b* is a graphical view showing waveforms of a high-frequency voltage, a driving frequency, and a voltage output from a voltage step-down circuit at starting time, respectively.
Figure 5C:
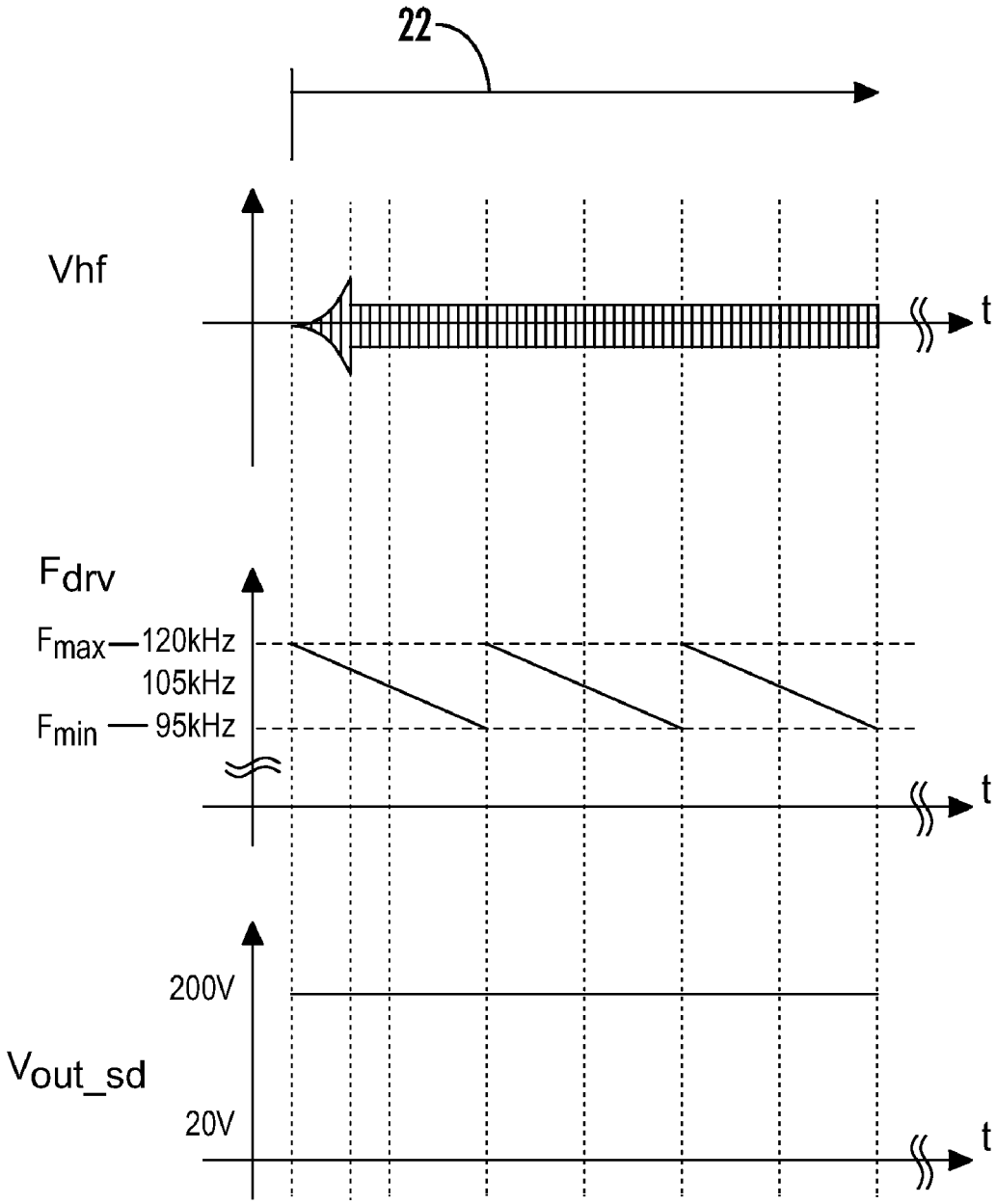
FIG. 5*c* is a graphical view of waveforms of a high-frequency voltage, a driving frequency, and a voltage output from the voltage step-down circuit if the discharge lamp is started at low voltage, respectively.

A ballast according to an embodiment of the present invention will now be described with reference to the drawings. It is to be noted, however, that a basic structural topology of the lamp ballast according to this embodiment is similar to that of the conventional lamp ballast as shown in FIG. 5*a* and described above. Therefore, common parts are denoted by the same reference symbols and not described. The lamp ballast of the present invention may be characterized however by various internal operating modes and more particularly the manner of controlling of a driving circuit 3 and a voltage step-down control circuit 4.

The driving circuit 3 of this embodiment includes a first mode of operation herein referred to as a frequency setting mode 24 for setting a driving frequency close to and above a resonance frequency F_res for a resonance circuit 20 while simultaneously preventing the lamp from starting. The driving circuit 3 further includes a second mode of operation, herein referred to as a starting mode 22 for adjusting the driving frequency Fdrv to the frequency set in the frequency setting mode 24, and for applying to a discharge lamp La a high frequency voltage Vhf high enough to start the lamp.

The voltage step-down control circuit 4 controls a voltage step-down circuit 1 to reduce a voltage output Vout_sd from the voltage step-down circuit 1 so as to inhibit starting of the discharge lamp La. In this embodiment, a voltage division circuit including a series connected resistive network R6, R7 is provided at the output of the voltage step-down circuit 1. By supplying a reference voltage from the voltage step-down circuit 1 output to the voltage step-down control circuit 4 from a node between the resistors R6, R7, the voltage output Vout_sd from the voltage step-down circuit 1 may be controlled to be equal to a predetermined voltage.

Figure 2:
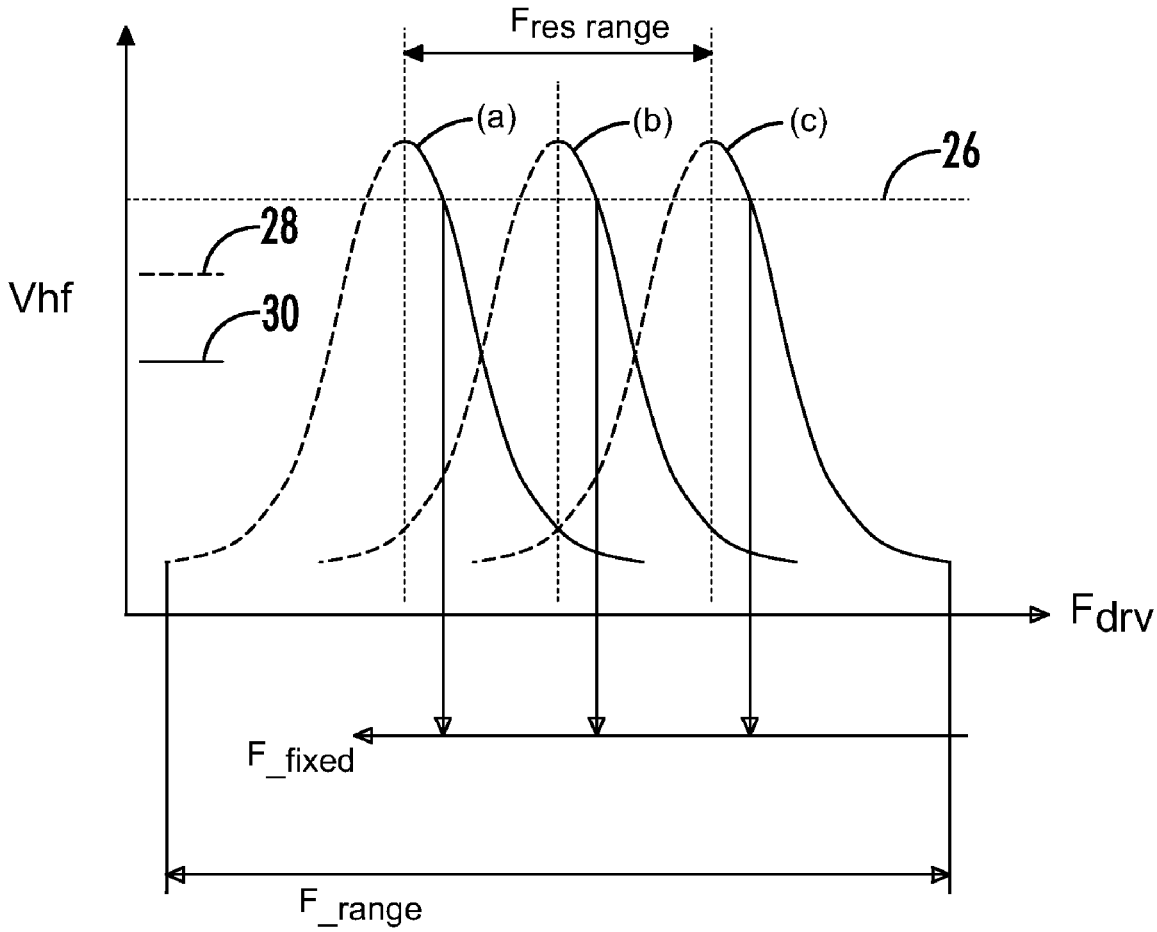
FIG. 2 is a graphical view in accordance with the embodiment of FIG. 1*a*, showing waveforms of various resonant frequencies within the expected tolerance of resonant circuit components.

As shown in FIG. 2, a range of resonance frequencies F_res_range for the resonant circuit 20 are indicated by waveforms (a), (b), (c) in accordance with potential value tolerances or variation of an inductance and a capacitance between an inductor L2 and a capacitor C2. If the high-frequency voltage Vhf reaches the predetermined voltage 26 at a frequency 30 above the resonant frequency, the driving circuit 3 stops sweep-controlling a driving frequency. By doing so, it is possible to cause the resonance circuit 20 to operate only at a frequency 30 above the resonant frequency in any of the displayed resonant frequency states (a), (b), (c).

However, as stated in the conventional example, if the discharge lamp La is lit in a state in which the high-frequency voltage is low, the high-frequency voltage cannot reach the predetermined voltage. As a result, the driving circuit 3 cannot stop the sweep-control and possibly cause the resonant circuit 20 to operate at a frequency 28 below the resonant frequency. Therefore, this embodiment solves the problems by setting the frequency setting mode 24 prior to the starting mode 22.

Figure 1A:
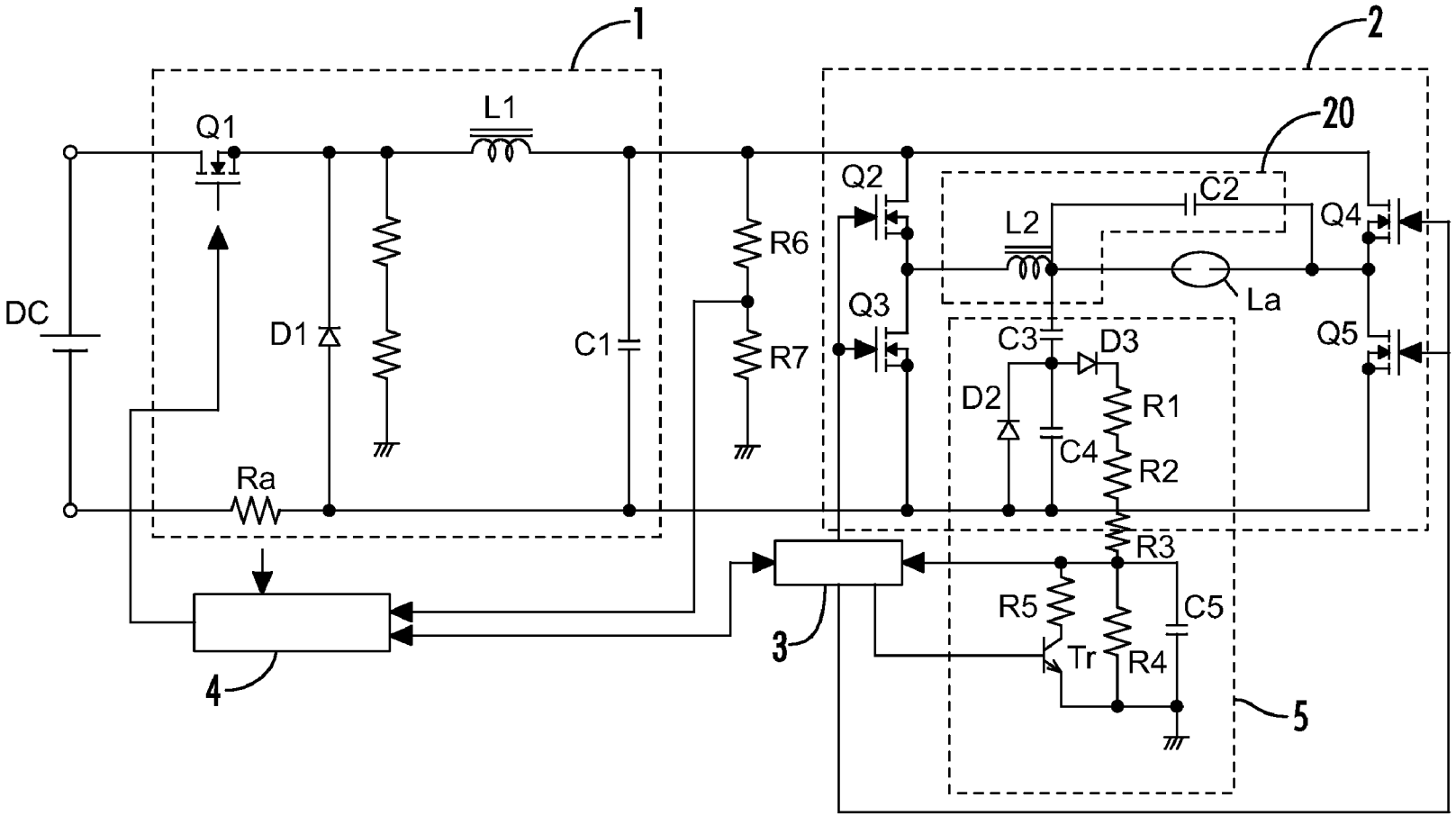
FIG. 1*a* is a circuit diagram showing a lamp ballast according to an embodiment of the present invention.
Figure 1B:
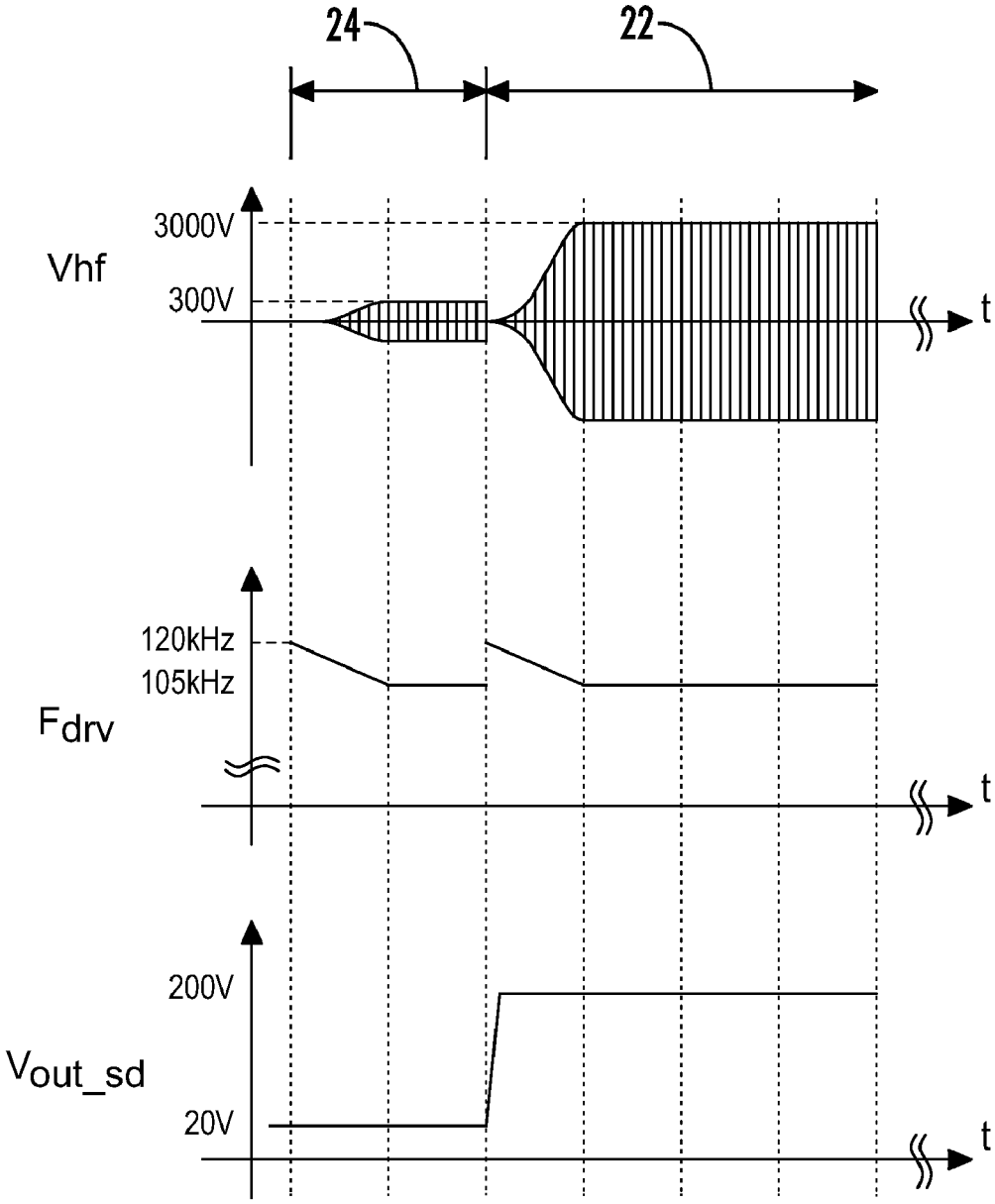
FIG. 1*b* is a graphical view showing waveforms of a high-frequency voltage, a driving frequency, and a voltage output from a voltage step-down circuit, respectively.

Operation of a ballast according to this embodiment may now be described with reference to the drawings. As shown in FIG. 1*b*, in the frequency setting mode 24, the driving circuit sweep-controls the driving frequency Fdrv in a state in which the voltage output Vout_sd from the voltage step-down circuit 1 is reduced sufficiently. In this example the voltage output Vout_sd may be reduced to 20 V, which is one-tenth of the 200 V that would be the output voltage Vout_sd during steady-state operation. The driving circuit 3 gradually reduces the driving frequency Fdrv from a preset initial frequency (of 120 kHz in this embodiment) to a frequency 30 near the resonant frequency (of 100 kHz in this embodiment) of the resonant circuit 20, and stops sweep-controlling the driving frequency Fdrv when the high-frequency voltage Vhf reaches the predetermined voltage 26 (of 300 V in this embodiment and labeled as such). The driving circuit 3 further sets the driving frequency (of 105 kHz in this embodiment) at this moment as a driving frequency F_fixed for stopping sweep-controlling of the driving frequency in the starting mode 22. In the frequency setting mode 24, the voltage step-down control circuit 4 reduces the voltage output Vout_sd from the voltage step-down circuit 1. Therefore, the high-frequency voltage that reaches 3000 V in the starting mode 22 reaches only 300 V in the frequency setting mode 24, and the discharge lamp La is not lit.

Once the driving circuit 3 sets the driving frequency Fdrv in the frequency setting mode 24, the driving circuit 3 may then move to the starting mode 22. At the same time, the voltage step-down control circuit 4 controls the voltage output Vout_sd from the voltage step-down circuit 1 to return to the output voltage Vout_sd for normal operation.

In various embodiments, the difference between the high-frequency voltage in the frequency setting mode 24 and that in the starting mode 22 may be relatively large. In light of this, in the voltage detection circuit 5 a series-connected circuit that includes a resistor R5 and an npn transistor Tr may be coupled in parallel to a resistor R4. In this configuration, the transistor Tr may be turned on to increase a voltage division ratio in the frequency setting mode 24, and the transistor Tr may be turned off to reduce the voltage division ratio in the starting mode 22, thereby improving detection accuracy of the voltage detection circuit 5.

As stated above, after setting the driving frequency Fdrv to the frequency F_fixed near to and above the resonance frequency for the resonant circuit 20 in the frequency setting mode 24, the driving circuit 3 may then move to the starting mode 22. It is thereby possible to stop sweep-controlling the driving frequency Fdrv at the preset driving frequency F_fixed whether the discharge lamp La is lit or not. It is, therefore, possible to prevent the driving frequency from sweeping to a frequency 28 lower than the resonant frequency F_res of the resonance circuit 20, and accordingly further possible to prevent the resonant circuit 20 from operating at a frequency 28 lower than its resonant frequency F_res.

In the embodiment as shown in FIG. 1*b*, the driving circuit 3 continues supplying the high-frequency voltage to the discharge lamp La at a level high enough to start the discharge lamp La in the starting mode 22.

Figure 3A:
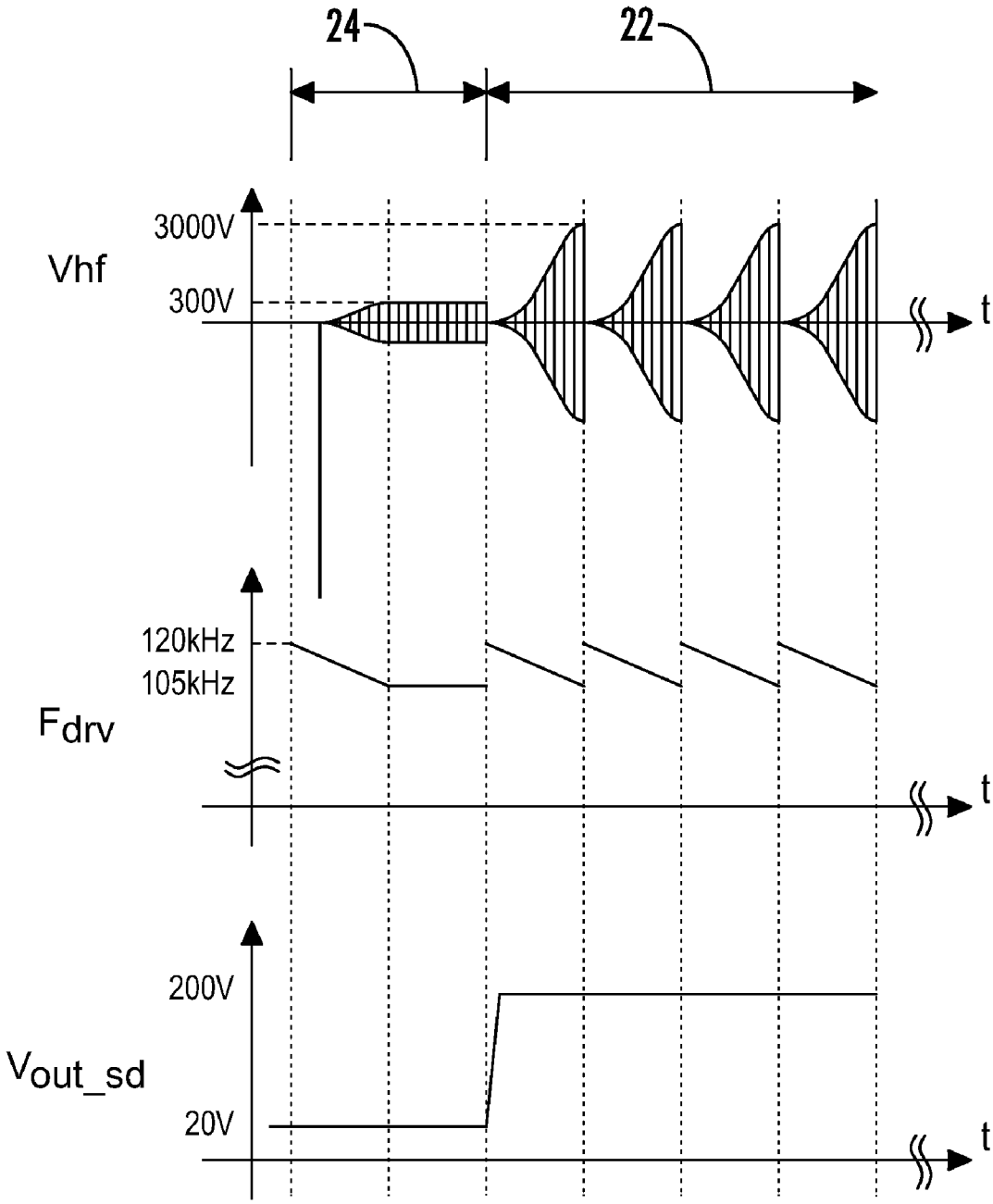
FIGS. 3*a*-3*c* show other operation examples in a starting mode according to the embodiment of FIG. 1*a*.

Alternatively, as shown in for example the embodiment of FIG. 3*a*, the driving circuit 3 can repeatedly exercise a series of controls. The driving circuit 3 here may adjust the driving frequency Fdrv from the preset initial frequency to the frequency F_fixed set in the frequency setting mode 24, and then if the lamp fails to ignite adjust again the driving frequency Fdrv from the initial frequency to the frequency set in the frequency setting mode 24. The process may repeat until the lamp strikes, or alternatively may repeat a finite number of times.

Figure 3B:
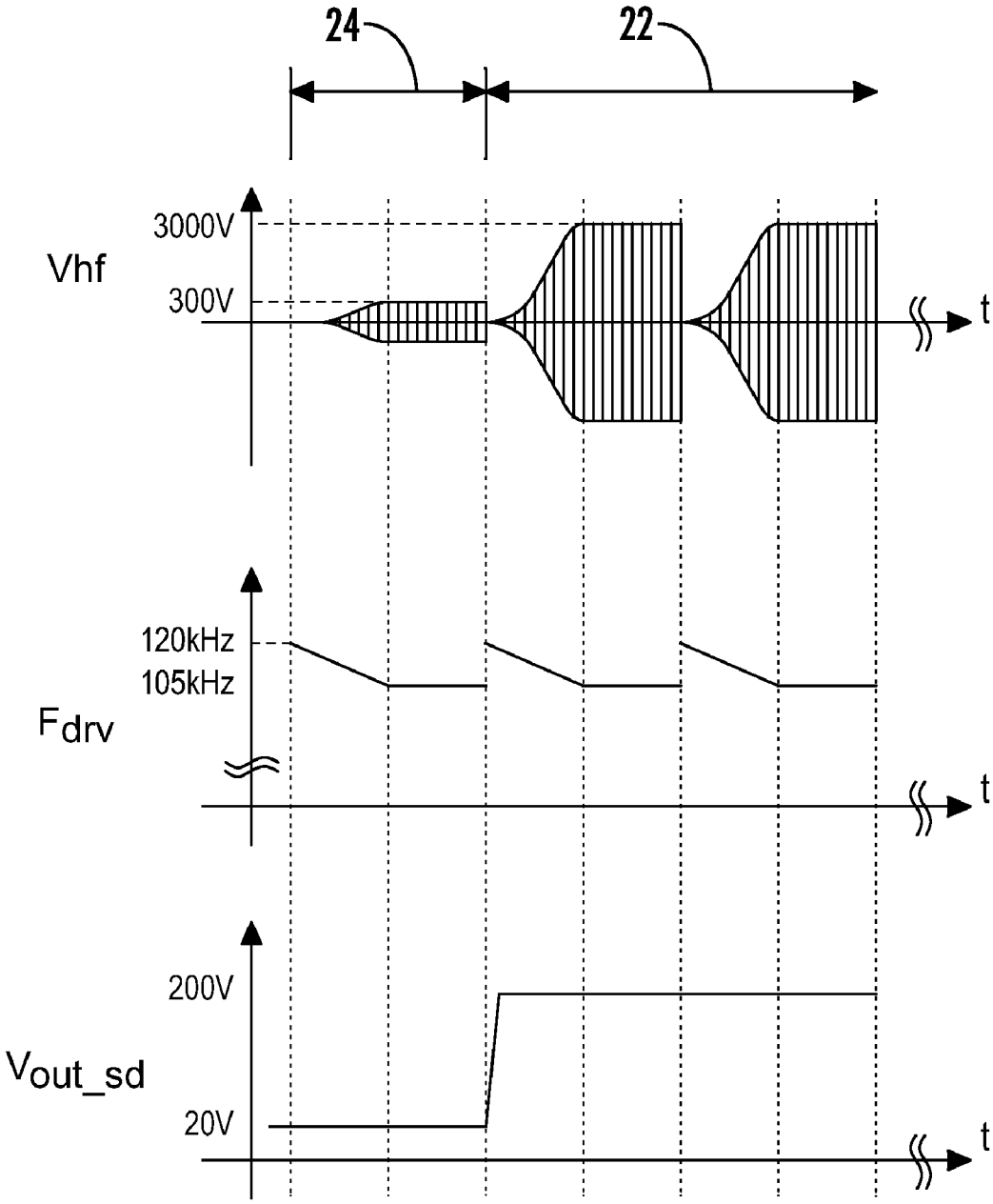

In yet another alternative embodiment as shown in FIG. 3*b*, the driving circuit 3 can repeatedly exercise a series of controls adjusting the driving frequency Fdrv from the preset initial frequency to the frequency F_fixed set in the frequency setting mode 24, and then holding the driving frequency Fdrv at the fixed frequency F_fixed for a predetermined period of time. In this case, it is possible to arbitrarily set an optimum time for supplying the high-frequency voltage to the discharge lamp La at a level high enough to start the discharge lamp La. Therefore, it is possible to reduce electric and thermal stresses on various elements of the resonant circuit 20 and those of the inverter circuit 2.

Figure 3C:
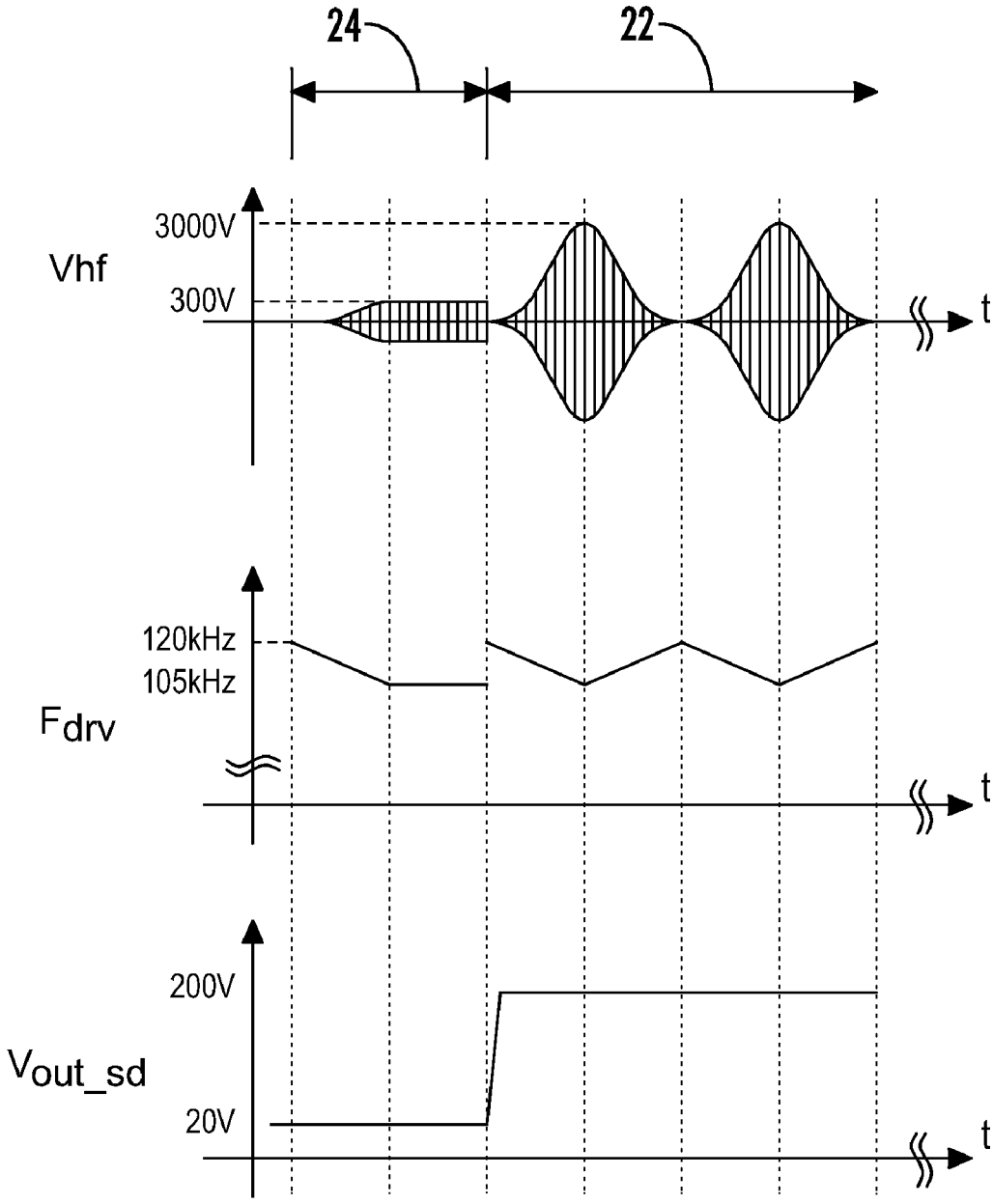

In yet another alternative embodiment as shown in FIG. 3*c*, the driving circuit 3 controls the driving frequency Fdrv to be adjusted from the preset initial frequency to the frequency F_fixed set in the frequency setting mode 24, and then if the lamp fails to ignite the driving frequency Fdrv may be adjusted again back to the initial frequency. The driving circuit 3 in this embodiment can repeatedly exercise a series of controls. In this case, it is possible to secure the high-frequency voltage Vhf high enough to start the discharge lamp La. It is also possible to reduce electric and thermal stress on various elements of the resonant circuit 20.

Figure 4:
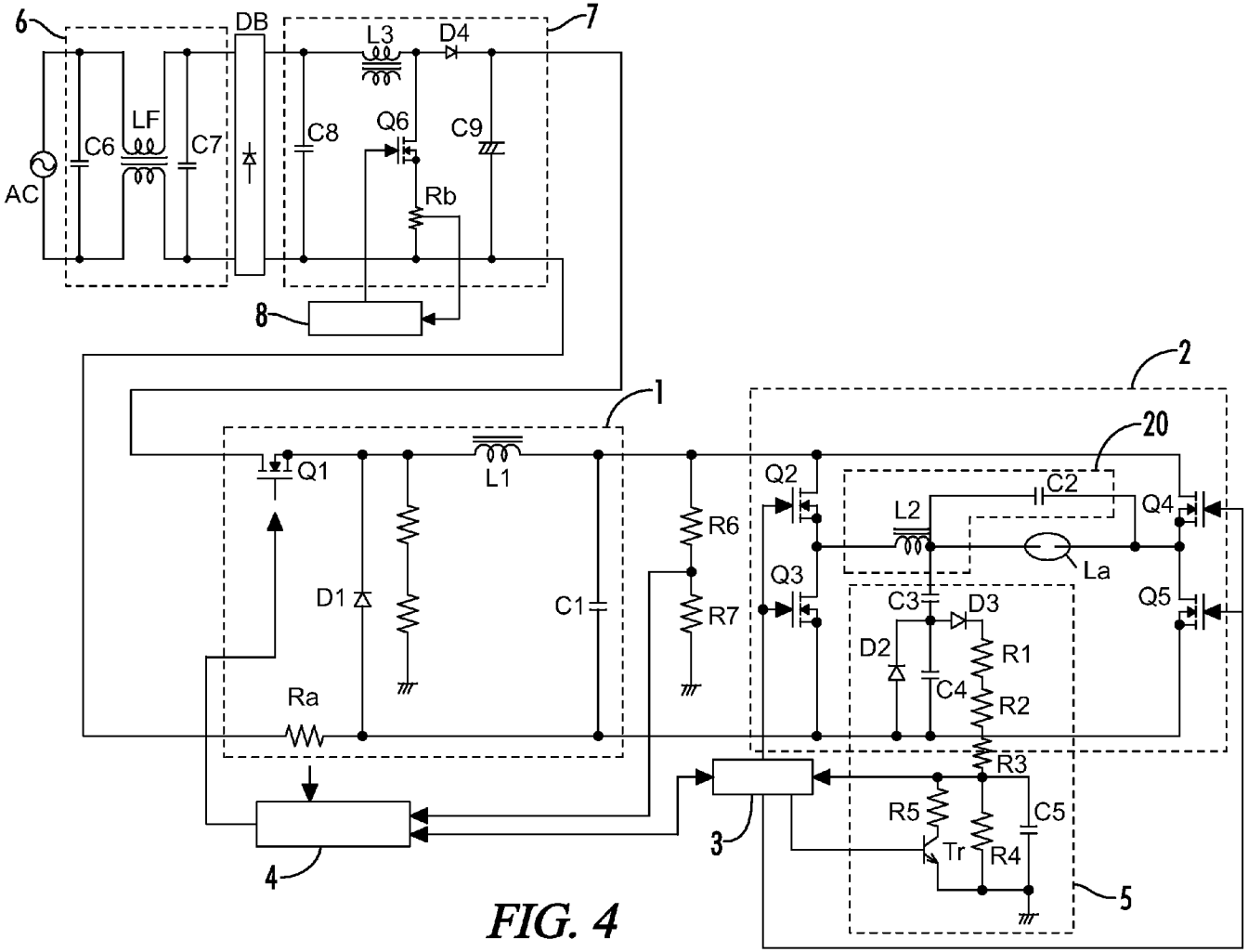
FIG. 4 is a circuit diagram showing a lamp ballast of an alternative embodiment of the present invention.

A ballast according to another embodiment of the present invention will now be described referring to FIG. 4. It may again be noted that a basic structural configuration of the lamp ballast according to this embodiment is substantially the same as that of the lamp ballast of the first embodiment. Therefore, common parts are denoted by the same reference symbols and not described. As shown in FIG. 4, an alternating-current power supply (AC) in place of the direct-current DC power supply (DC), a filter circuit 6, a rectifying circuit DB, a step-up circuit 7, and a step-up control circuit 8 are provided.

The filter circuit 6, which eliminates noise in an AC voltage from the AC power supply AC, may be configured to include capacitors C6 and C7 and a line filter LF. The rectifying circuit DB, which may include a diode bridge, rectifies the AC voltage from the AC power source AC and outputs a pulsating voltage. The step-up circuit 7 may be configured to include capacitors C8 and C9, an inductor L3, a diode D4, and a switching element Q6. The step-up circuit 7 is capable of switching the switching element Q6 on or off to thereby raise the pulsing voltage from the rectifying circuit DB, cause the capacitor C9 to smooth the raised pulsing voltage, and output a desired DC voltage across both ends of the capacitor C9.

A detection resistor Rb for detecting a current flowing through the switching element Q6 may be connected in series to the switching element Q6. The step-up control circuit 8 may be a microprocessor and supplies a driving signal for controlling the switching of the switching element Q6. The step-up control circuit 8 changes a frequency of the driving signal according to the current detected by the detection resistor Rb, thereby controlling the voltage output from step-up circuit 7 to be equal to a predetermined voltage. Since the respective circuits are well known, they are not described herein in detail.

Each of the embodiments described herein may be applied to an illumination fixture, including a fixture main body accommodating therein the lamp ballast or a projector including the lamp ballast, and can exhibit similar effects to those stated above.

The previous detailed description has been provided for the purposes of illustration and description. Thus, although there have been described particular embodiments of the present invention of a new and useful "HID Lamp Ballast with Controlled DC Step-Down Circuit," it is not intended that such references be construed as limitations upon the scope of this invention except as set forth in the following claims.

What is claimed is:

1. An electronic ballast for powering a high intensity discharge lamp, the ballast comprising:

a voltage step-down circuit arranged to reduce a DC voltage provided by a DC power supply;

an inverter circuit coupled to receive said reduced voltage, said inverter circuit including at least one high frequency switching element and arranged to provide a high frequency AC voltage as a function of a driving signal;

a resonant circuit coupled to receive the high frequency AC voltage from the inverter circuit, and further operable to couple to the discharge lamp;

a voltage step-down control circuit configured to control the DC voltage output from the voltage step-down circuit;

a driving circuit configured to supply the driving signal to the at least one switching element of the inverter circuit, and further configured to adjust a driving frequency of the driving signal, thereby controlling the high-frequency voltage;

wherein the voltage step-down control circuit controls the DC voltage output from the voltage step-down circuit to a low level such that the high frequency AC voltage in a first operating mode is controlled to a low level wherein the lamp is prevented from starting while the driving circuit sweeps the driving frequency of the driving signal down from a preset initial frequency until the high frequency AC voltage increases to a predetermined voltage, and wherein the voltage step-down control circuit controls the DC voltage output from the voltage step down circuit to a high level such that the high frequency AC voltage in a second operating mode is controlled to a high level wherein the discharge lamp can be started and the driving frequency of the driving signal is prevented from going below the driving frequency at which the high frequency AC voltage increased to the predetermined voltage in the first operating mode.

2. The ballast of claim 1, the first operating mode further comprising a frequency setting mode for the driving circuit, and the driving circuit configured in the frequency setting mode to fix the driving frequency at a frequency near to and above a resonant frequency for the resonant circuit.

3. The ballast of claim 2, the voltage step-down control circuit configured to control the voltage step-down circuit to reduce the DC voltage output from the voltage step-down circuit, wherein the discharge lamp is prevented from starting in the frequency setting mode.

4. The ballast of claim 3, the voltage step-down circuit further comprising a capacitor and a switching element, wherein a switching rate of the step-down switching element is controllable to provide a reduced voltage across the ends of the capacitor.

5. The ballast of claim 4, further comprising a current detector for detecting a current flowing through the discharge lamp, the current detector coupled to the voltage step-down control circuit, the voltage step-down control circuit configured to control the voltage step-down circuit by providing a driving signal to the step-down switching element that is adjusted in accordance with the detected load current.

6. The ballast of claim 4, further comprising a voltage dividing circuit coupled to receive an output of the voltage step-down circuit and to provide an input to the voltage step-down control circuit, the voltage step-down control circuit configured to control the voltage step-down circuit by providing a driving signal to the step-down switching element that is adjusted in accordance with the voltage input from the voltage dividing circuit.

7. The ballast of claim 3, the second operating mode of the driving circuit further comprising a starting mode for adjusting the driving frequency to the frequency set in the frequency setting mode.

8. The ballast of claim 7, further comprising a high-frequency voltage detection circuit for detecting the high-frequency voltage, wherein the driving circuit changes the driving frequency until the high-frequency voltage detected by the voltage detection circuit in the frequency setting mode reaches the predetermined voltage, and the driving circuit controls the high-frequency voltage to fix the driving frequency upon reaching the predetermined voltage.

9. The ballast of claim 8, the high frequency voltage detection circuit further comprising a transistor, wherein the transistor may be turned on to increase a voltage division ratio in the frequency setting mode, and the transistor may be turned off to reduce the voltage division ratio in the starting mode, thereby improving detection accuracy of the voltage detection circuit.

10. The ballast of claim 8, wherein the driving circuit is configured to:

adjust the driving frequency from the preset initial frequency to the frequency set in the frequency setting mode, fix the frequency for a predetermined period of time in the starting mode, and repeat at least once said sequence of adjusting the driving frequency and fixing the frequency.

11. The ballast of claim 8, wherein the driving circuit is configured to:

adjust the driving frequency from the preset initial frequency to the frequency set in the frequency setting mode, adjust again the driving frequency to the preset initial frequency in the starting mode, and repeat at least once said sequence of adjusting the driving frequency in both of the frequency setting mode and the starting mode.

12. An electronic ballast for powering a gas discharge lamp, the ballast comprising:

a rectifying circuit arranged to rectify an AC input voltage and produce a DC voltage;

a step-up circuit arranged to receive the DC voltage from the rectifying circuit and raise the DC voltage;

a step-down circuit arranged to reduce the DC voltage provided by the step-up circuit;

an inverter circuit coupled to receive the DC voltage from the step-down circuit, the inverter circuit including a plurality of high frequency switching elements and arranged to produce a high frequency AC voltage as a function of a driving signal;

a resonant circuit coupled to receive the high frequency AC voltage from the inverter circuit, and further operable to couple to the discharge lamp;

a step-up control circuit configured to control the DC voltage output from the step-up circuit;

a step-down control circuit configured to control the DC voltage output from the step-down circuit;

a driving circuit configured to supply the driving signal to the switching elements of the inverter circuit, and further configured to adjust a driving frequency of the driving signal;

wherein the voltage step-down control circuit controls the DC voltage output from the voltage step-down circuit to a low level such that the high-frequency AC voltage in a first operating mode is controlled to a low level wherein the lamp is prevented from starting while the driving circuit sweeps the driving frequency of the driving signal down from a preset initial frequency until the high frequency AC voltage increases to a predetermined voltage, and wherein the voltage step-down control circuit controls the DC voltage output from the voltage step down circuit to a high level such that the high-frequency AC voltage in a second operating mode is controlled to a high level wherein the discharge lamp may be started and the driving frequency of the driving signal is prevented from going below the driving frequency at which the high frequency AC voltage increased to the predetermined voltage in the first operating mode.

13. The ballast of claim 12, the first operating mode further comprising a frequency setting mode for the driving circuit, the driving circuit configured in the frequency setting mode to fix the driving frequency at a frequency near to and above a resonant frequency for the resonant circuit, and the step-down control circuit configured in the frequency setting mode to provide a DC output voltage of a first low level.

14. The ballast of claim 13, the second operating mode further comprising a starting mode for the driving circuit, the driving circuit configured for adjusting the driving frequency to the frequency set in the frequency setting mode, and the step-down control circuit configured in the starting mode to provide a DC output voltage of a second high level.

15. The ballast of claim 14, further comprising a high-frequency voltage detection circuit for detecting the high-frequency voltage, wherein the driving circuit changes the driving frequency until the high-frequency voltage detected by the voltage detection circuit in the frequency setting mode reaches the predetermined voltage, and the driving circuit controls the high-frequency voltage to fix the driving frequency upon reaching the predetermined voltage.

16. A method of powering a gas discharge lamp, the method comprising the steps of:

(a) providing an electronic ballast having a step-down circuit for reducing an input voltage, an inverter circuit having a plurality of high frequency switching elements for converting the reduced input voltage to a high frequency voltage, and a resonant circuit coupled to the lamp;

(b) reducing the step-down circuit output voltage wherein the high frequency voltage is insufficient to start the lamp;

(c) controlling a switching frequency of the inverter switching elements to sweep from a maximum frequency to a minimum frequency while the step-down circuit output voltage is reduced such that the high frequency voltage is insufficient to start the lamp, the maximum and minimum frequencies determined in association with a resonant frequency for the resonant circuit;

(d) fixing the switching frequency of the inverter switching elements at a particular frequency above the resonance frequency, said particular frequency determined upon detecting a predetermined high frequency voltage while controlling the switching frequency of the inverter switching elements to sweep from the maximum frequency to the minimum frequency while the step-down circuit output voltage is reduced such that the high frequency voltage is insufficient to start the lamp;

(e) raising the step-down circuit output voltage to a startup level; and (f) controlling the switching frequency of the inverter switching elements to sweep from a preset startup frequency to the particular fixed frequency while the step-down circuit output voltage is raised to the startup level to start the lamp.

17. The method of claim 16, wherein the preset startup frequency is the maximum frequency.

18. The method of claim 16, further comprising the steps of:

(g1) if the lamp ignites, reducing the high frequency voltage to a steady state level, (g2) if the lamp fails to ignite, repeating step (f) at least once.

19. The method of claim 16, step (f) comprising the steps of:

(f1) sweeping the switching frequency of the inverter switching elements from a preset startup frequency to the fixed frequency;

(f2) controlling the switching frequency to be fixed at the fixed frequency for a predetermined period of time;

the method further comprising the steps of (g1) if the lamp ignites, reducing the high frequency voltage to a steady state level; and (g2) if the lamp fails to ignite, repeating step (f) at least once.

20. The method of claim 16, further comprising the steps of:

(g1) if the lamp ignites, reducing the high frequency voltage to a steady state level; and (g2) if the lamp fails to ignite, sweeping the switching frequency from the fixed frequency to the preset starting frequency and then repeating at least once steps (f) through (g).

* * * * *